United States Patent [19]

Kinney

[11] 3,932,978

[45] Jan. 20, 1976

[54] WORM-TYPE DISPENSER FOR RIMMED CONTAINERS

[75] Inventor: Alfred W. Kinney, Kansas City, Mo.

[73] Assignee: Phillips Petroleum Company, Bartlesville, Okla.

[22] Filed: Oct. 21, 1974

[21] Appl. No.: 516,479

Related U.S. Application Data

[62] Division of Ser. No. 370,532, June 15, 1973, Pat. No. 3,849,970.

[52] U.S. Cl. ..... 53/37; 53/40; 53/289; 221/222

[51] Int. Cl.[2] ..... B67B 3/00; B65B 7/28

[58] Field of Search ..... 53/40, 37, 29, 41, 289, 53/282, 313, 314, 367; 221/222

[56] References Cited

UNITED STATES PATENTS

| | | | |
|---|---|---|---|
| 2,946,481 | 7/1960 | Carew | 221/222 |
| 3,137,982 | 6/1964 | Decker et al. | 221/222 X |
| 3,192,565 | 7/1965 | Rukavina | 221/222 X |
| 3,295,293 | 1/1967 | Lodding | 53/289 X |
| 3,408,787 | 11/1968 | Mueller | 53/37 |
| 3,426,941 | 2/1969 | Hovekamp | 221/222 |

*Primary Examiner*—Travis S. McGehee
*Assistant Examiner*—Horace M. Culver

[57] ABSTRACT

A worm-type dispenser for rolled rim paperboard containers has a compression bead in the rim-engaging grooves of the worm to flex the central portion of the rim to render it more resilient so a cover having a rim contacting cylindrical skirt may be applied more easily.

10 Claims, 6 Drawing Figures

WORM-TYPE DISPENSER FOR RIMMED CONTAINERS

This is a division of copending application Ser. No. 370,532, filed June 15, 1973, now U.S. Pat. No. 3,849,970.

This invention relates to method and apparatus for sequentially dispensing containers having a rim. In a specific embodiment, the invention relates to a system for dispensing, filling and capping containers having a rolled rim.

The rolled rim of a frusto-conical or round container produced of paperboard that may be coated and/or compensated with a plastic or other material is a relatively rigid and stable ring surrounding the open end of the container. In order to form a complete package to contain whatever product may be used, a closure must be placed on the container. This is usually in the form of a disc of a size to cover the opening plus enough more to extend the disc to near that of the specified rim diameter. A depending skirt extended from the outer periphery of the disc frictionally engages the outer surface of the rim to retain the closure on the container.

There must be sufficient closeness of dimensions between the outside diameter of the rim on the container and the inside diameter of the closure skirt to provide the required friction, yet not enough interference to prevent the closure from going on when being applied in the capping unit of high speed packaging equipment. It is obvious that the rim diameter must not be below a certain specified limit and the internal diameter of the closure skirt must not be above a maximum allowable limit or there will be no friction fit and the closure will not stay on the container.

To achieve the above conditions, container forming equipment is usually adjusted to produce containers with rims at or near the maximum specified limit and closure forming equipment is adjusted to produce closures with the depending skirt inside diameter at or near the minimum specified limit. Due to the many variables involved in producing containers and closures of paperboard, such as fiber length, moisture content, printing, coating, etc., it is extremely difficult to maintain close tolerances. The result is a large percentage of products where the interference between the closure's depending skirt internal diameter and the outside diameter of the rigid rim of the container is such that the closure cannot be readily applied.

Accordingly, it is an object of the present invention to provide means that will affect the rim in such a manner that the oversize containers will accept the closures as applied. Another object of the invention is to provide a new and improved means for dispensing, filling and capping containers having a rolled rim. Another object of the invention is to increase the ease of capping a rimmed container. Yet another object of the invention is to improve the fit of a closure on a container having a rolled rim. Other objects, aspects and advantages of the invention will be apparent from a study of the specification, the drawings and the appended claims to the invention.

This invention covers the method, apparatus, and end result of a relatively rigid rim having a predetermined portion of its outer periphery transformed to a relatively flexible state during dispensing that permits it to flex inward as the closure is applied and to spring against the inside of the depending skirt of the closure when it is in place, thus providing maximum frictional retention. Changing the condition of the portion of the rim is accomplished while the container is in pre-dispense position while passing through the cup dispenser worm spirals. The center portion of the rim (that is the central portion of the rim when measured vertically with the container in a normal position) is compressed inwardly so that the diameter of the compressed portion is substantially less than the original maximum outside diameter of the container rim. This action stretches the fibers in the material and imparts a flexibility to the rim. The snap-back portion of the rim is readily compressed when the closure is applied.

Figure 1:
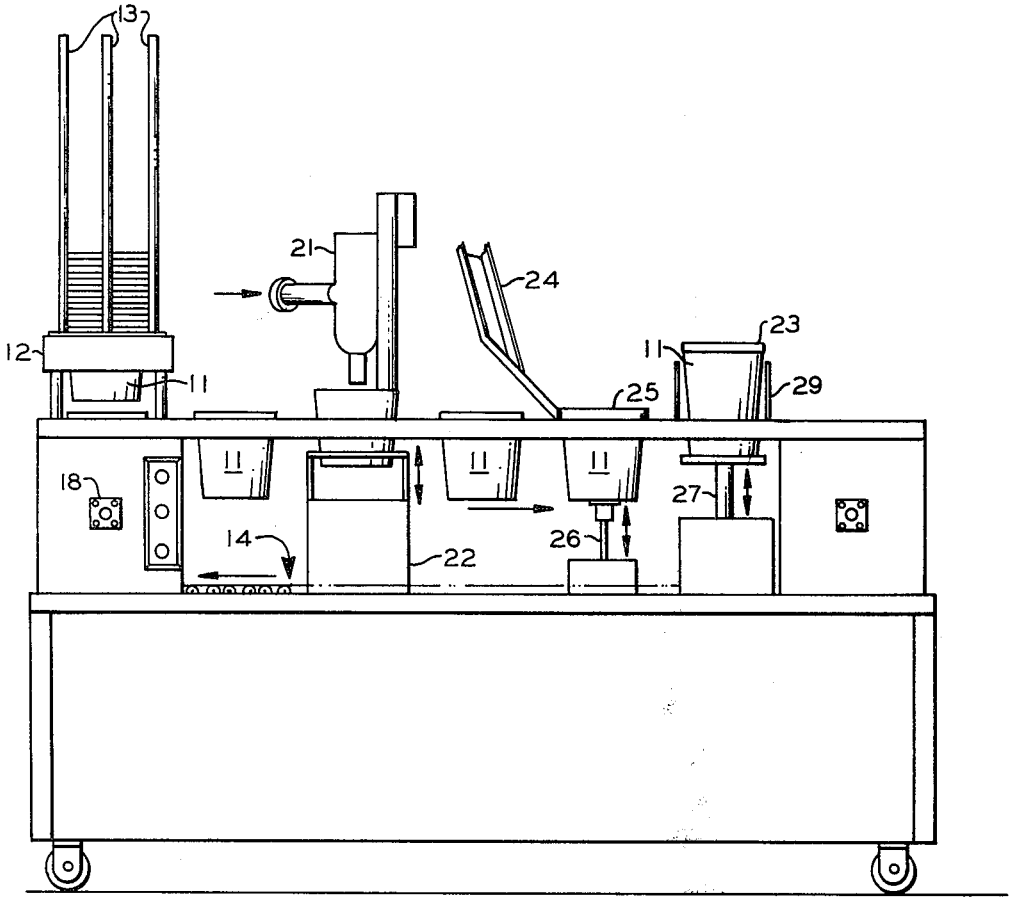
FIG. 1 is an elevational view of a filling and capping machine incorporating the present invention.
Figure 3:
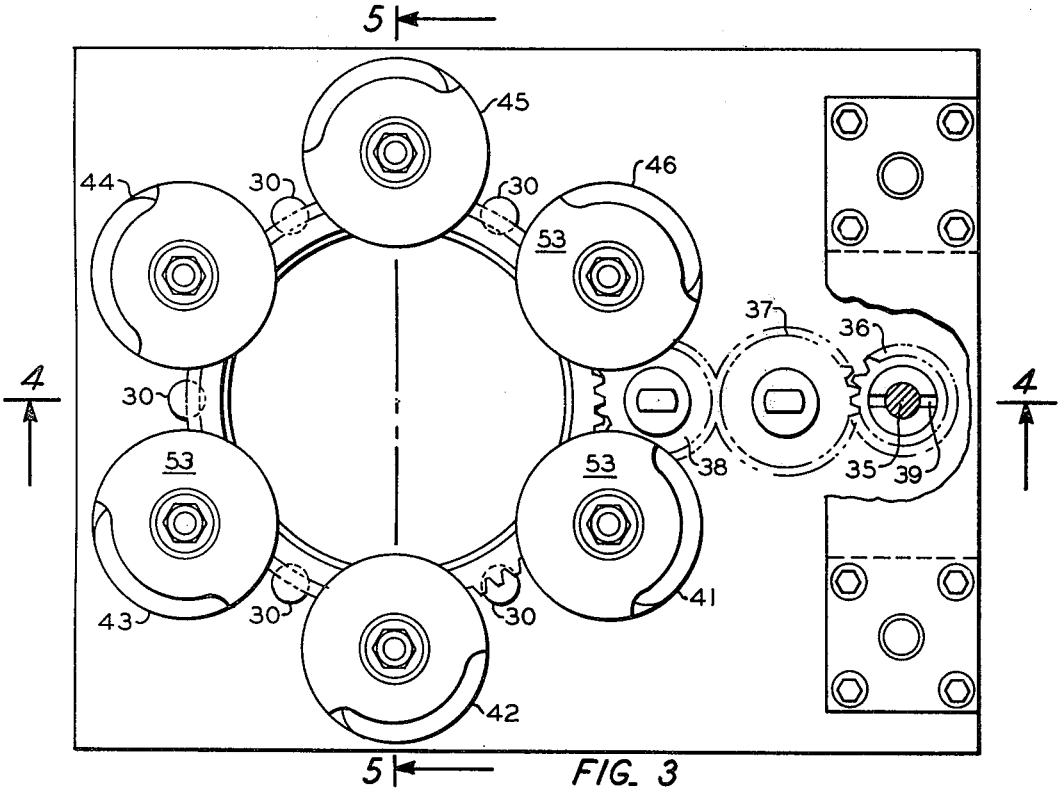
FIG. 3 is a plan view of the container dispensing mechanism.
Figure 2:
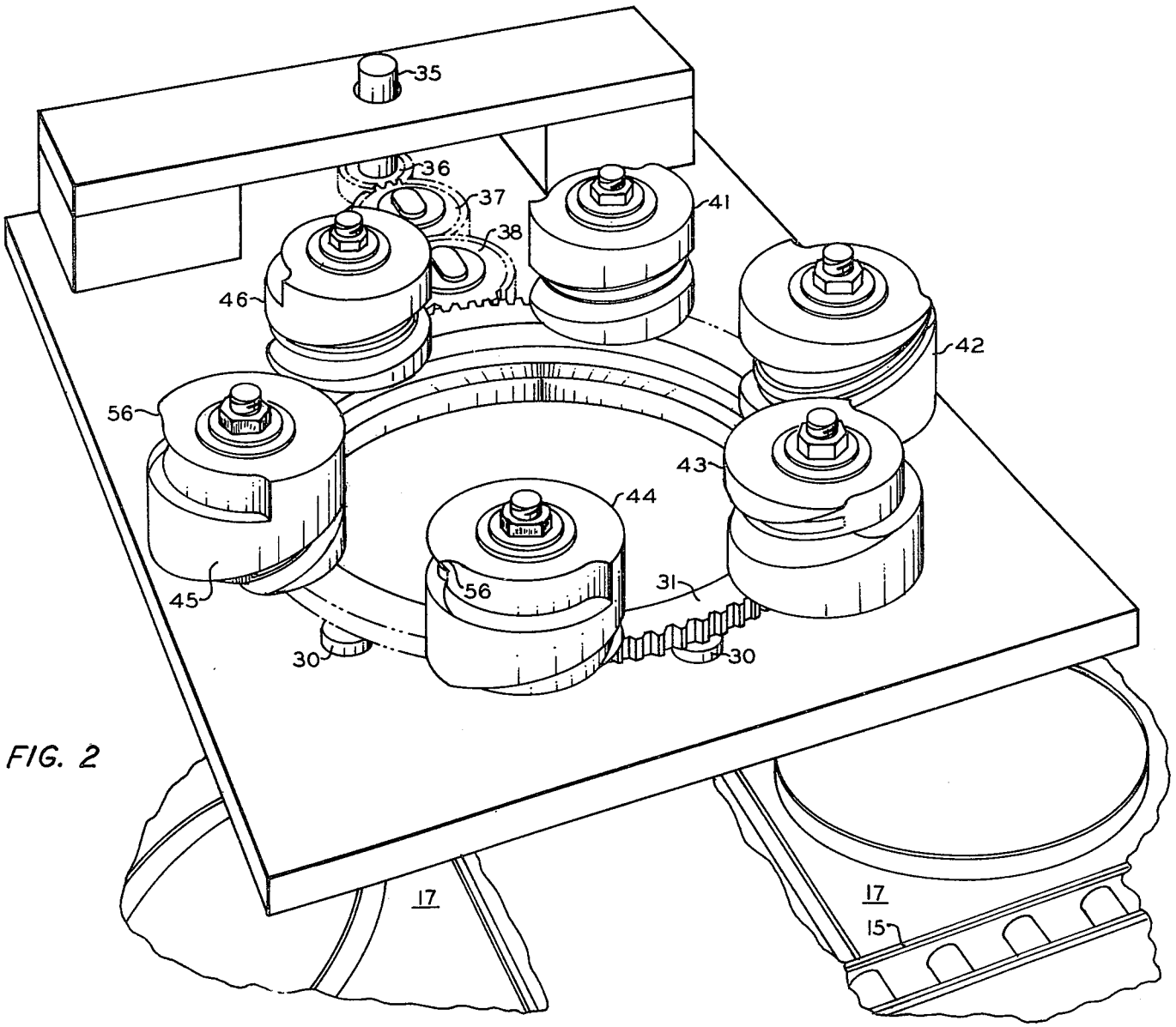
FIG. 2 is a perspective view of the container dispensing mechanism of FIG. 1.
Figure 4:
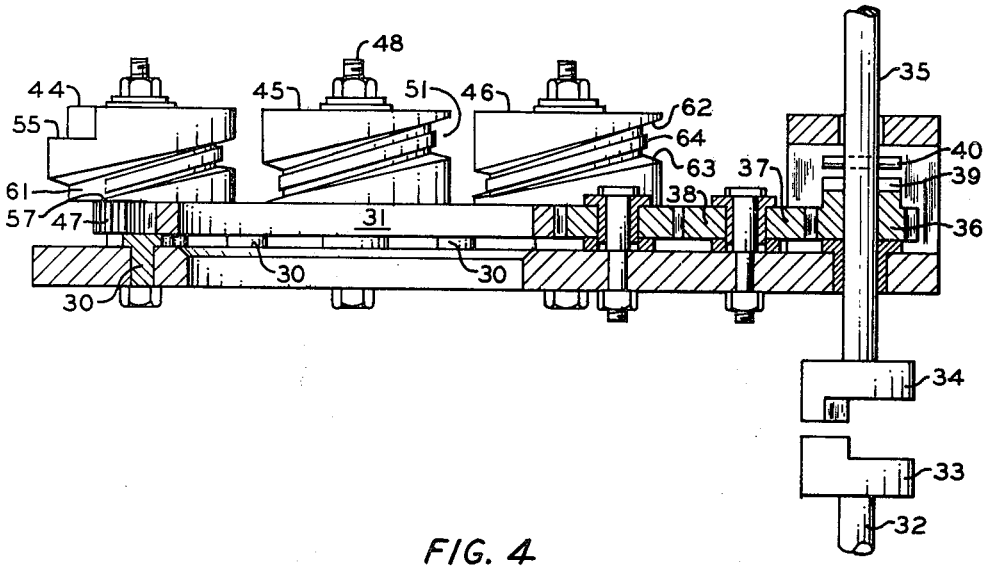
FIG. 4 is an elevational view in cross section taken along line 4—4 in FIG. 3.
Figure 5:
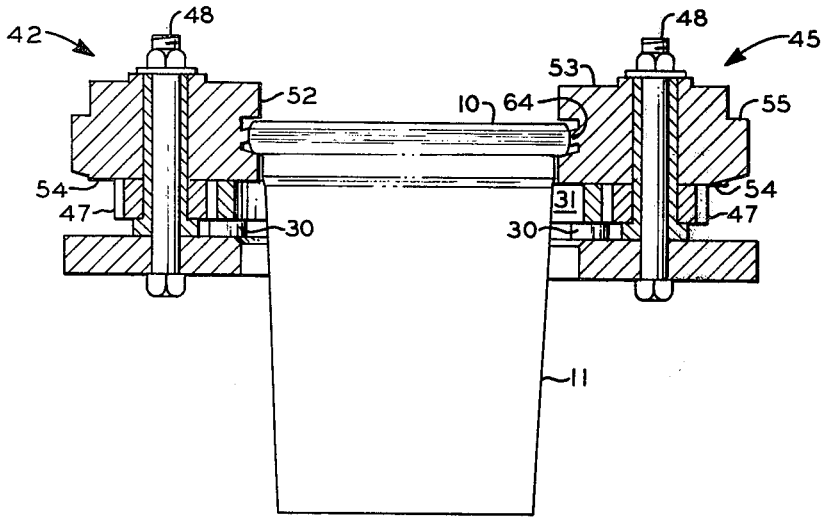
FIG. 5 is an elevational view in cross section taken along line 5—5 in FIG. 3, with a container added.
Figure 6:
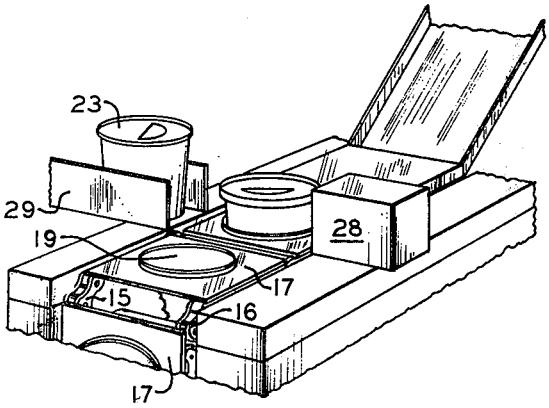
FIG. 6 is a partial view in perspective of the mechanism for transferring filled and capped containers to an output chute.

Referring now to FIG. 1, a nested stack of containers 11 is supported by container dispensing machanism 12 and four vertical guide rods 13 over an endless conveyor 14. Each paperboard container 11 has a generally circular horizontal cross section and is provided with an annular rolled rim 10 projecting outwardly and downwardly from the upper end or mouth thereof. As shown in FIGS. 2 and 6, conveyor 14 comprises two parallel endless chains 15 and 16 and a plurality of container supporting members 17 carried by chains 15 and 16. Conveyor 14 is indexed in a stepwise manner by drive axle 18. During the dwell portion of each step or cycle, mechanism 12 separates the lowermost container 11 from the stack and drops the separated container into the opening 19 in the container supporting member 17 which is positioned in the container receiving station below dispensing mechanism 12. Filler valve 21 is actuated during the dwell portion of each cycle to introduce the material to be packaged into the container 11 positioned in the filling station of the conveyor. If desired, a container lift mechanism 22 can be employed to raise the container 11 to be filled so that the outlet end of filler valve 21 is inside the container and adjacent the bottom of the container before the filler valve 21 is actuated. Mechanism 22 can then gradually lower the container as it is being filled to provide uniform distribution of the product in the container.

Closures 23 are fed into chute 24, the lower end of which is positioned over conveyor 14, in such a manner that the leading edge of the lowermost closure is contacted by the leading edge of the rim of the container 11 as conveyor 14 indexes the container into the capping station. The forward motion of the container 11 draws the engaged closure 23 from chute 24, while the contact of the upper surface of the closure 23 with a horizontal plate 25 forces the closure 23 down onto the rim of the container 11. If desired, container marking mechanism 26 can be actuated during the dwell portion of each cycle to raise the container 11 and the associated closure 23 into firm contact with plate 25 to firmly seal the closure 23 on the container 11 and to apply indicia to the bottom of the container.

During the dwell portion of each cycle, lift mechanism 27 is actuated to raise the filled and capped container which is in the transfer station of conveyor 14 to a position above conveyor 14 and then transfer mechanism 28 (FIG. 6) is actuated to move the elevated container laterally of conveyor 14 and onto an output chute 29.

In FIGS. 2 through 5, the container dispensing mechanism 12 is illustrated without its cover. A ring gear 31, having external gear teeth, is driven in the clockwise direction, as viewed in FIG. 3, by the drive system comprising drive shaft 32, clutch plates 33 and 34, clutch shaft 35, and gears 36, 37 and 38. The ring gear 31 rides on a plurality of bearings 30. Gear 36 has a slot 39 therein to receive pin 40 when clutch shaft 35 is in the down or engaged position. Pin 40, which extends through shaft 35 and is secured therein, engages gear 36 when shaft 35 is in the down position to rotate gear 36 responsive to the rotation of shaft 35. Shaft 35 can be latched in the up position by suitable means (not shown) to permit access to the container dispensing mechanism 12 without shutting down the remainder of the machine.

Each of the six feed worm gears 41–46 is provided with an interlocked gear 47 which engages ring gear 31. Feed worm gears 41–46 are rotated about their respective rotating shafts 48 in the counterclockwise direction, as viewed in FIG. 3, by the mounted worm drive gear 47 and ring gear 31. The six worm gears 41–46 are positioned in a circular array which is coaxial with the stack of nested containers, with the cylindrical axis of each worm gear being parallel to the elongated, generally vertical, axis of the stack of containers. Each of the feed worm gears 41–46 is in the form of a cylinder having a groove 51 in the cylindrical surface 52 extending in a generally spiral form from the top 53 of the worm gear to the bottom 54 thereof. The vertical height between opposite sidewalls of groove 51 is greater than the vertical height of rim 10. The groove 51 can be enlarged at the upper end thereof to provide an initial shoulder portion 55 which is at least generally perpendicular to the axis of the cylindrical surface 52. Each of the worm gears 41–46 is positioned to simultaneously receive in the groove 51 thereof the rim 10 of the lowermost container 11 in the stack. Immediately prior to the discharge of the lowermost container 11 by the container dispensing mechanism 12, the rim 10 of the next higher container is supported by the top surface of each of the worm gears 41–46. At the moment or shortly thereafter that the lowermost container 11 is discharged by the mechanism 12, the worm gears 41–46 have rotated to the position where the initial shoulder portions 55 are under the rim of the next higher container and the rim of the second container is no longer supported by the upper surface, thereby peritting the entire stack of nested containers to drop until the rim of the new lowermost container rests on initial shoulder portion 55 of each worm gear. The distance between shoulder portion 55 and the top surface 53 is slightly greater than the vertical height of the rim 10, but is less than the container stacking distance, i.e., the distance from the bottom of the rim of one container to the bottom of the rim of the next higher container. Thus, on the continued rotation of worm gears 41–46, leading point 56 of each of the worm gears 41–46 enters the space between the top of the rim 10 of the lowermost container 11 and the bottom of the rim 10 of the next higher container to support the second container on the top surface 53 while the descending path of grooves 51 forces the lowermost container to separate from the second container and move downwardly. When the worm gears 41–46 have rotated to the point where the trailing edge 57 moves out from under the rim 10 of the lowermost container 11, the lowermost container drops into the pocket 19 of the container supporting member 17 which is in the container receiving status of conveyor 14.

Each groove 51 has an inner wall or bottom 61 generally parallel to the cylindrical surface 52 of the respective worm gear 41–46, as well as an upper sidewall 62 and a lower sidewall 63. The vertical height from the bottom sidewall 63 to the top sidewall 62 is slightly larger than the vertical height of the rim 10 of container 11. The horizontal distance from the inner wall 61 of one of the worm gears 41–46 to the inner wall 61 of the opposite worm gear, i.e., the diameter of the smallest circle which is coaxial with the ring gear 31 and tangent to each inner wall 61, is slightly greater than the horizontal diameter of rim 10. The corresponding horizontal distance from the cylindrical surface 52 of one worm gear to the cylindrical surface 52 of the opposite worm gear is less than the horizontal diameter of rim 10 but is greater than the maximum external diameter of container 11 below rim 10.

In accordance with the present invention, at least one of, and preferably all, of the worm gears 41–46 are provided a bead 64 extending outwardly along at least a portion of the length of inner wall 61 of groove 51. Bead 64 has a width, or vertical height, less than the width of the groove 51 and is spaced from and preferably centered between upper sidewall 62 and lower sidewall 63. In general, the width of bead 64 will be in the range of about 0.1 to 0.8, preferably from about 0.2 to about 0.7, and more preferably from about 0.3 to about 0.6, of the width, or vertical height, of groove 51. Each bead 64 extends along the groove 51 for at least one-tenth of the length of groove 51, and preferably for at least one-fourth of the length of groove 51. The bead 64 has a sufficient horizontal thickness to cause the portion of the container rim 10 which contacts the bead 64 to be compressed inwardly so that the maximum outside horizontal diameter of the compressed portion of rim 10 is substantially less than the original maximum outside diameter of the uncompressed rim. The inwardly directed compression of the central portion of the outer vertical wall of rim 10 breaks the stiffness of paper of the rim as well as forming the outer vertical wall of rim 10 into a generally corrugated configuration, thereby increasing the flexibility of the rim. The compression of the rim 10 to the diameter of the circle which is coaxial with ring gear 31 and is tangent to the beads 64 at the closest point to the axis of gear 31 overcomes any variations in the maximum diameter of rim 10 due to variations in manufacturing conditions, variations in humidity during storage, and variations in type and thickness of the paper utilized to form container 11. As the paper containers have an elastic memory, the rim 10 will tend to return to its original condition. However, the recovery takes longer than is required for the treated container to be dispensed into pocket 29 of conveyor 14, filled and capped. Thus, the compression or crimping of rim 10 by the beads 64 significantly improves the ease of moving a closure 23 into place on the container. It is desirable that an even number, preferably at least four, feed worm gears be employed so that the worm gears would be in direct opposition to each other. It is also desirable that the number of worm gears be sufficient to assure that the full circumference of the rim is compressed as the container rotates in the dispenser.

Reasonable variations and modifications are possible within the scope of the foregoing disclosure, the drawings and the appended claims to the invention.

I claim:

1. A process for filling and capping a paperboard container having a circular horizontal cross section and having an annular rolled rim projecting outwardly and downwardly from the upper end of said container, said rolled rim having an outer generally vertical wall with an original maximum outside diameter, said outer generally vertical wall having a central portion as determined by measuring vertically with the container in the normal position, which comprises applying inwardly directed pressure about the at least substantially entire horizontal circumference of said rim to said central portion of said outer generally vertical wall of the rim of the container to thereby inwardly compress said central portion so that the diameter of the thus compressed central portion is less than the original maximum outside diameter of said rim, and substantially immediately thereafter filling and capping the thus treated container with a closure having a depending cylindrical skirt, said skirt having an internal diameter greater than the maximum outside diameter of the thus compressed rim and approximately equal to said original maximum outside diameter of the uncompressed rim such that said skirt frictionally engages the outer surface of said rim when said compressed rim tends to return to its original condition after said thus treated container is capped with said closure.

2. A process in accordance with claim 1 wherein said pressure is applied to said rim about the at least substantially entire horizontal circumference of said rim to form a horizontal corrugation in said rim.

3. A process in accordance with claim 1 which further comprises vertically positioning a stack of a plurality of paperboard containers, each of said plurality of paperboard containers having a circular horizontal cross section and having an annular rolled rim projecting outwardly and downwardly from the upper end of the respective container, each said rolled rim having an outer generally vertical wall with an original maximum outside diameter, each said outer generally vertical wall having a central portion as determined by measuring vertically with the container in the normal position, and separating the lowermost container in said stack from the remainder of the containers in said stack; and wherein said step of applying inwardly directed pressure is effected on the rim of said lowermost container in said stack as said lowermost container is separated from the remainder of the containers in said stack.

4. A process in accordance with claim 1 wherein said step of applying inwardly directed pressure is effected simultaneously at a plurality of points spaced circumferentially about said rim.

5. A process in accordance with claim 1 wherein said container is rotated about its longitudinal axis as said pressure is applied to the rim thereof.

6. A process in accordance with claim 1 wherein said rim is relatively rigid and wherein said step of applying inwardly directed pressure transforms said central portion of the vertical wall of said rim to a relatively flexible state that permits said rim to flex inwardly as said closure is applied and to spring outwardly against the inside of the depending skirt of the closure when the closure is in place, thus providing frictional retention of said closure on the thus capped container.

7. A process in accordance with claim 6 wherein said pressure is applied to said rim about the at least substantially entire horizontal circumference of said rim to form a horizontal corrugation in said rim.

8. A process in accordance with claim 7 which further comprises vertically positioning a stack of a plurality of paperboard containers, each of said plurality of paperboard containers having a circular horizontal cross section and having an annular rolled rim projecting outwardly and downwardly from the upper end of the respective container, each said rolled rim having an outer generally vertical wall with an original maximum outside diameter, each said outer generally vertical wall having a central portion as determined by measuring vertically with the container in the normal position, and separating the lowermost container in said stack from the remainder of the containers in said stack; and wherein said step of applying inwardly directed pressure is effected on the rim of said lowermost container in said stack as said lowermost container is separated from the remainder of the containers in said stack.

9. A process in accordance with claim 8 wherein said step of applying inwardly directed pressure is effected simultaneously at a plurality of points spaced circumferentially about said rim.

10. A process in accordance with claim 9 wherein said lowermost container is rotated about its longitudinal axis as said pressure is applied to the rim thereof.

* * * * *